US006541443B1

(12) United States Patent
Rojo

(10) Patent No.: US 6,541,443 B1
(45) Date of Patent: Apr. 1, 2003

(54) MULTIFUNCTIONAL DETERGENT MATERIALS

(75) Inventor: Jose Andres Rojo, Mexico City (MX)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/762,901

(22) PCT Filed: Aug. 17, 1999

(86) PCT No.: PCT/US99/18655

§ 371 (c)(1),
(2), (4) Date: Feb. 14, 2001

(87) PCT Pub. No.: WO00/09641

PCT Pub. Date: Feb. 24, 2000

Related U.S. Application Data

(60) Provisional application No. 60/096,758, filed on Aug. 17, 1998.

(51) Int. Cl.[7] ..... C11D 3/06; C11D 3/08

(52) U.S. Cl. ..... 510/512; 510/276; 510/288; 510/347; 510/431; 510/453; 510/510; 510/511; 510/531

(58) Field of Search ..... 510/276, 288, 510/347, 431, 453, 510, 511, 531, 512

(56) References Cited

U.S. PATENT DOCUMENTS

| | | | | |
|---|---|---|---|---|
| 2,568,110 | A | | 9/1951 | Beiley et al. |
| 3,127,238 | A | | 3/1964 | Fuchs |
| 3,450,494 | A | * | 6/1969 | Gaiser ..... 23/110 |
| 3,579,455 | A | | 5/1971 | Sabatelli et al. |
| 3,879,527 | A | | 4/1975 | Bertorelli et al. |
| 3,907,538 | A | | 9/1975 | Hauschild |
| 3,912,649 | A | | 10/1975 | Bertorelli et al. |
| 3,956,467 | A | | 5/1976 | Bertorelli |
| 3,971,727 | A | | 7/1976 | Bertorelli et al. |
| 4,007,124 | A | | 2/1977 | Collier et al. |
| 4,018,616 | A | | 4/1977 | Sugahara et al. |
| 4,018,720 | A | | 4/1977 | Lengyel et al. |
| 4,019,998 | A | | 4/1977 | Benson et al. |
| 4,022,704 | A | | 5/1977 | Balfanz et al. |
| 4,101,455 | A | | 7/1978 | Francis et al. |
| 4,106,922 | A | | 8/1978 | Hauschild et al. |
| 4,113,644 | A | | 9/1978 | Ashcraft |
| 4,167,406 | A | | 9/1979 | Hauschild et al. |
| 4,187,190 | A | | 2/1980 | McLaughlin et al. |
| 4,207,197 | A | | 6/1980 | Davis et al. |
| 4,220,673 | A | | 9/1980 | Strobel |
| 4,226,636 | A | | 10/1980 | Mizutani et al. |
| 4,228,025 | A | | 10/1980 | Jacobsen |
| 4,284,532 | A | | 8/1981 | Leikhim et al. |
| 4,294,810 | A | | 10/1981 | Taga et al. |
| 4,362,641 | A | | 12/1982 | Peterson |
| 4,394,358 | A | | 7/1983 | Maurer et al. |
| 4,436,653 | A | | 3/1984 | Jacobsen et al. |
| 4,438,024 | A | | 3/1984 | DelGreco et al. |
| 4,496,526 | A | | 1/1985 | Loblich |
| 4,511,543 | A | | 4/1985 | Keren et al. |
| 4,512,905 | A | | 4/1985 | Clearfield et al. |
| 4,567,030 | A | | 1/1986 | Yuasa et al. |
| 4,572,807 | A | | 2/1986 | Hagele |
| 4,591,575 | A | | 5/1986 | Okabayashi et al. |
| 4,725,369 | A | | 2/1988 | Nathan et al. |
| 4,767,558 | A | | 8/1988 | Ouhadi et al. |
| 4,798,712 | A | | 1/1989 | Peterson |
| 5,035,872 | A | | 7/1991 | Loblich et al. |
| 5,036,030 | A | | 7/1991 | Taga et al. |
| 5,215,732 | A | | 6/1993 | Hachgenei et al. |
| 5,262,142 | A | | 11/1993 | Koga et al. |
| 5,268,031 | A | | 12/1993 | Lassiter et al. |
| 5,268,156 | A | | 12/1993 | Schimel et al. |
| 5,296,027 | A | | 3/1994 | Ernst et al. |
| 5,302,363 | A | | 4/1994 | Highfill et al. |
| 5,336,477 | A | | 8/1994 | Koga et al. |
| 5,344,633 | A | | 9/1994 | Sorensson et al. |
| 5,510,096 | A | | 4/1996 | Fukuyama et al. |
| 5,614,160 | A | | 3/1997 | Gill et al. |
| 5,616,277 | A | | 4/1997 | Raleigh et al. |
| 5,624,651 | A | | 4/1997 | Bass |
| 5,643,358 | A | | 7/1997 | Borgstedt et al. |
| 5,672,390 | A | | 9/1997 | Crews IV et al. |
| 5,693,304 | A | | 12/1997 | Borgstedt et al. |
| 5,703,258 | A | | 12/1997 | Blount |
| 5,707,960 | A | | 1/1998 | Fukuyama et al. |

FOREIGN PATENT DOCUMENTS

| | | |
|---|---|---|
| EP | 488 868 | 6/1992 |
| EP | 0 561 656 A1 | 9/1993 |
| WO | WO 95/23841 A1 | 9/1998 |

* cited by examiner

*Primary Examiner*—Charles Boyer
(74) *Attorney, Agent, or Firm*—Marianne Dressman; Julia A. Glazer; Kim William Zerby

(57) ABSTRACT

A multifunctional detergent material, useful in laundry and cleaning product compositions, containing functional ingredients including a condensed phosphate material and a silicate material, and optionally other inorganic materials, such as carbonate and sulfate. The condensed phosphate material forms an amorphous phase containing polyphosphates, while the silicate material is present as crystalline particulate. The composition can be used to provide multiple functions for laundry and cleaning products in a single ingredient, including the functions of a builder, a filler, and an alkaline source.

9 Claims, 3 Drawing Sheets

MULTIFUNCTIONAL DETERGENT MATERIALS

This application claims the benefit of No. 60/096,758, filed Aug. 17, 1998.

FIELD OF THE INVENTION

This invention relates to a single multifunctional detergent material comprising inorganic compounds containing inorganic oxides used in laundry and cleaning products.

BACKGROUND OF THE INVENTION

Conventional laundry and cleaning products contain numerous inorganic compounds, usually in a form comprising one or two inorganic oxides. Each of such compounds performs one or more functions, such as the functions of a builder, a conditioner, an alkaline agent, a filler, a carrier, and a neutralizing agent, in the detergent and/or in the process for its manufacture. A high number of raw materials which can be used for a particular laundry or cleaning product formulation, imparting their respective functions, can account for a considerable portion of the cost of producing the detergents. Each raw material has its separate processing cost, transportation cost, operating expense, and other fixed or variable costs.

The processing of laundry and cleaning products has generally involved the separate addition of the inorganic oxides in the process for making the product, involving the storage, feeding, and control of the inorganic oxide stock into the process stream to deliver the target level of inorganic oxide actives into the product. Depending upon the amount or mass rate of a stock to be used, and the physical and flow properties and chemical purity of the stock, the actual level of inorganic oxide active can vary more or less than the target level in the detergent product. Consequently, manufacturers incur a significant cost and expense in installing feeders and controllers to deliver the appropriate amount and rate of stock material, and in analyzing raw material stock and finished detergent products for the appropriate level of inorganic oxide active.

The most common inorganic oxides that are found in inorganic compounds that are used to make laundry and cleaning products are phosphorus oxide ($P_2O_5$), sodium oxide ($Na_2O$), carbon dioxide ($CO_2$), and silica ($SiO_2$). Other additional oxide ingredients can include boron oxide ($B_2O_3$) and sulfur trioxide ($SO_3$). Usually, these inorganic oxides are combined with sodium oxide ($Na_2O$) or other alkali or alkali metal oxide to form and make the commercially-available inorganic compounds that can be processed into laundry and cleaning. For example, the silica can be delivered into the product in the form of amorphous or crystalline silicate having the general formula $xSiO_2{:}Na_2O$, where x is about 1 to about 3.8. Silica can also be introduced as an aluminosilicates such as a zeolite, and as a layered silicate. Phosphorous oxide is commonly supplied in the form of hydrated or anhydrous sodium tripolyphosphate ($Na_5O_{10}P_3$), tetrasodum pyrophosphate ($Na_4O_7P_2$), and orthophosphate ($Na_3O_4P$).

The pure inorganic oxides and/or inorganic compounds are generally obtained from nature in the form of minerals and ores. Natural sources of silica are silica sand, quartzite, and cristobalite. A natural source of phosphorous oxide is phosphoric rock. A natural source of sodium carbonate is trona. Natural sources of sodium sulfate ($Na_2SO_4$) are mirabilite and thenardite.

The natural sources of inorganic oxides may contain impurities or inert by-products which are normally removed from the natural material before or during converting to the inorganic compound commercial stock. Sodium tripolyphosphate (STPP), for example, is made by first reacting ground phosphoric rock with sulfuric acid to form phosphoric acid; silica ($SiO_2$) is an impurity of this reaction which is ordinarily filtered from the phosphoric acid. In turn, the phosphorus acid is reacted with sodium carbonate to form STPP. The silica impurity, though eliminated from the STPP, is nevertheless a material which is commonly present in detergent formulation in some other form.

Sodium carbonate, a common source of $Na_2O$, can be obtained from the treatment of trona mineral by a process including grinding, diluting, filtering to eliminate compounds considered as impurities (including again silica), and crystallizing, to obtain the sodium carbonate. The sodium silicate can be obtained from melt reacting a mixture of silica sand and sodium carbonate at high temperatures in a furnace.

Silica is an impurity compound in these natural sources of inorganic oxides, and the processing required to eliminate the silica impurity from each individual natural raw material contributes to some of the cost of the detergent chemical compounds, and consequently to the final detergent.

U.S. Pat. No. 5,707,960, issued to Fukuyama et al. On Jan. 13, 1998, discloses an amorphous sodium silicate-metal sulfate composite powder for use as a detergent builder. The powder is made by heat fusing a metal sulfate, silica, and sodium carbonate or sodium hydroxide at a temperature and time sufficient to fuse the SiO2; cooling the fused mixture into cullet, and grinding the cullet into the composite powder.

WO 9902643 (Vitro Corporation) discloses a process for making a multifunctional component for detergent compositions, by mixing natural and treated minerals containing the essential oxides for the detergent compositions, and reacting the mixture in a furnace, thereby forming a powder or glass containing the essential oxides.

However, phosphate builders such as STPP and TSPP are important laundry and cleaning product ingredients, and are widely used in many parts of the world as the principle detergent builder. Consequently there remains a need to develop improved functional raw materials for laundry and cleaning products, and for processes to make the same.

It is therefore an object of the present invention to provide a single multifunctional detergent material that can include several, and preferably three or more, of the typical inorganic oxides normally included in laundry and cleaning product, and can have the product functions of these inorganic oxides, such as the functions of a builder, a conditioner, a filler, an alkaline agent, a carrier, or a neutralizing agent.

It is also an object to provide a multifunctional detergent material (hereinafter, "MFDM") containing multiple inorganic oxides, in a single material which is less expensive to manufacture and to use in the making of laundry and cleaning products, and which eliminates the need to add each raw material separately into the process for making the laundry or cleaning product. The addition of each raw material in the process can include the unloading, storage, feeding, and metering of the raw material.

It is yet another object to provide a single multifunctional detergent material which enables accurate control of the delivered level of inorganic oxides into a particular laundry or cleaning product formulation.

It is also an object to provide a multifunctional detergent material for detergent formulations, which can provide unique product performance properties, compared to conventional inorganic oxide mixtures and components.

Another object of the present invention is to provide a laundry or cleaning composition or component thereof, containing or made using a single multifunctional detergent material that contains many of the required inorganic oxides for the detergent formulations.

These and other objects and advantages of the product and the process of the present invention will be apparent from the following description and specific examples of the invention.

SUMMARY OF THE INVENTION

The present invention provides a multifunctional detergent material, useful in laundry and cleaning product compositions, comprising at least two functional inorganic oxide ingredients selected from phosphorous oxide and silicon dioxide. Preferably the material comprises a phosphate component comprising phosphorus oxide ($P_2O_5$) and sodium oxide ($Na_2O$), and a silicate component comprising silicon oxide ($SiO_2$) and sodium oxide. The phosphate component comprises a linear polyphosphate, a cyclic metaphosphate, or mixtures thereof, in addition to other lower phosphates such as orthophosphate and pyrophosphate.

DETAILED DESCRIPTION OF THE INVENTION

Figure 1:
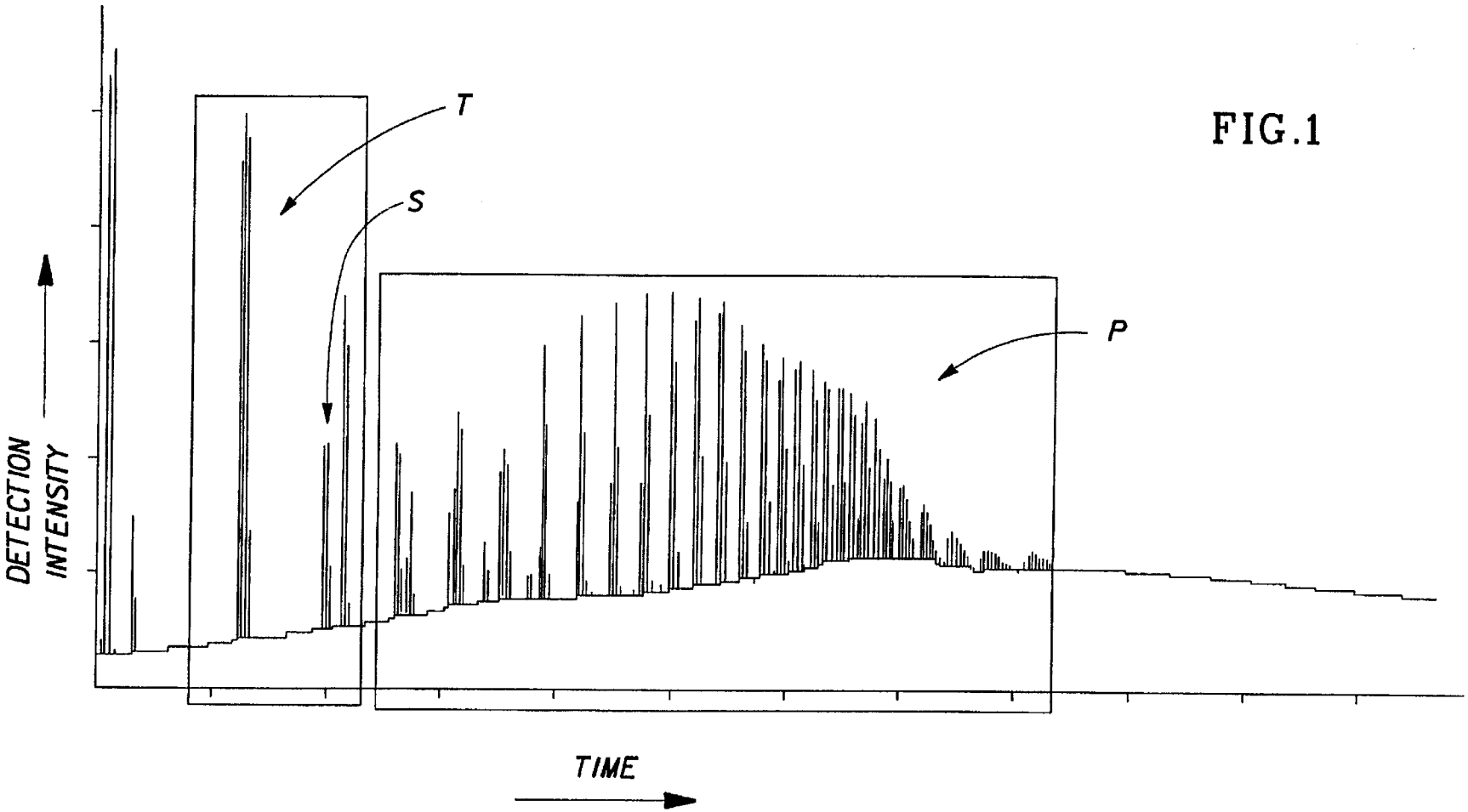
FIG. 1 shows an Ion Chromatogram of a multifunctional detergent material of the present invention, according to Example 3, showing the polyphosphate and other phosphate species contained in the material.

The present invention provides a multifunctional detergent material, useful in laundry and cleaning product compositions, comprising a solid solution of at least two functional inorganic oxide ingredients selected from phosphorous oxide and silicon dioxide. Preferably the material comprises a condensed phosphate component comprising phosphorus oxide ($P_2O_5$) and sodium oxide ($Na_2O$), and a silicate component comprising silicon oxide ($SiO_2$) and sodium oxide.

The phosphorus oxide ingredient can be expressed by the formula $(Na_2O)_a(P_2O_5)_b$, where the ratio of a:b is from about 0 to about 3, and more preferably about 0.8 to about 2. The phosphorous oxide ingredient (hereinafter also referred to as the condensed phosphate component of the MFDM) can comprise a variety of phosphate species that include: ultraphosphates, which are randomly (amorphous) or ordered (crystalline) interconnected chains and/or rings, and metaphosphates, which are ring structures, that have a ratio of a:b of from above 0 to about 1; polyphosphates, which are linear chains of P-O-P units, that have a ratio of a:b of from about 1 to about 2, and include sodium tripolyphosphate (STPP) having a structure $Na_5O_{10}P_3$ and a ratio a:b of 5/3; tetrasodium pyrophosphate (TSPP) having a structure $Na_4O_7P_2$ and a ratio a:b of 2:1; trisodium orthophosphate having a structure $Na_3O_4P$ and a ratio a:b of 3:1; and mixtures thereof. Preferably the MFDM comprises a condensed phosphate component selected from the group consisting of linear polyphosphates, cyclic metaphosphates, and mixtures thereof.

The linear polyphosphate has a structure of formula I:

I

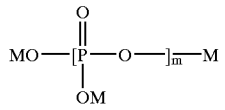

where m can range from 3–100, and preferably from 3–30, and where M is selected from Na, K, Li, and H, and mixtures thereof, and is preferably Na. When m is 3, the linear polyphosphate is sodium tripolyphosphate.

The cyclic metaphosphate has a structure of formula II:

II

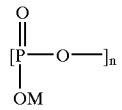

where n can range from 3–20, and preferably from 3–10, and where M is selected from Na, K, Li, and H, and mixtures thereof, and is preferably Na.

Linear polyphosphates and cyclic metaphosphates having m greater than 3 are also referred to herein as higher polyphosphates.

Preferably, the MFDM of the present invention comprises from about 10% to about 99% percent by weight of a mixture of the linear polyphosphate and cyclic metaphosphate. Typically the weight ratio of polyphosphate to metaphosphate is from about 40:1 to about 1:1, and more preferably about 20:1 to about 4:1. The MFDM can also contain other phosphate materials such as orthophosphate and pyrophosphate, or other extremely long (m greater than 100) polyphosphates.

The silicon oxide ingredient is generally present as a silicate expressed by the formula $(SiO_2)_x(Na_2O)_y$, where the ratio of x:y is from about 0.5:1 to about 4:1, more preferably about 0.7:1 to about 1.3:1. The silicon oxide ingredient can also be referred to as the silicate component of the MFDM.

As previously discussed above, a third inorganic oxide contained in the MFDM is disodium oxide, or $Na_2O$. It is present in combination with the phosphorous oxide to form the condensed phosphate component, and with the silicon oxide to form the silicate component, but can also be present as a free component.

In the presence of moisture, the linear polyphosphates and cyclic metaphosphates can be hydrolyzed to the lower phosphates, including orthophosphate, pyrophosphate, and sodium tripolyphosphate. This hydrolysis can be accelerated by higher temperatures (generally above about 39° C.), and at extreme acidic or alkali conditions of pH. Consequently, the MFDM of the present invention, can also comprise a solid solution of a condensed phosphate component and a silicate component wherein a substantial portion of the polyphosphates and/or metaphosphates present have been hydrolyzed to the lower phosphates, including STPP and TSPP. Preferably the weight average chainlength ($n_{avg}$) of the polyphosphates is greater than 6, more preferably greater than 13, and most preferably greater than 20.

The MFDM comprises from about 5% to about 60%, more preferably from about 10% to about 50%, by weight of condensed phosphate component expressed as $P_2O_5$, and from about 5% to about 50%, more preferably from about 15% to about 50%, by weight of silicate expressed as $SiO_2$. Preferred embodiments of MFDM comprise the phosphorus oxide ($P_2O_5$) and the silicon oxide ($SiO_2$) ingredients at a weight ratio of from about 1:20 to about 12:1, more preferably from about 1:5 to about 3:1. The MFDM can comprise from about 5% to about 80%, more preferably from about 10% to about 60%, by weight the condensed phosphate component, and from about 10% to about 60%, more preferably from about 15% to about 50%, the silicate component In the MFDM, the alkali metal sodium (Na) can be replaced in part or in total with another alkali metals, such as lithium (Li) or potassium (K), or alkali earth metals, such as calcium (Ca) or magnesium (Mg).

In one preferred embodiment, the MFDM can be described as a solid solution, wherein the condensed phosphate component and the silicate component are miscible and form a single solid phase. One component will form a continuous solid phase, having the other component as a dispersed solid phase therein. The miscibility of the condensed phosphate component with the silicate component will depend upon the proportion of the $SiO_2$, $P_2O_5$ and $Na_2O$ contained in reaction mixture. Preferably, the continuous solid phase comprises the condensed phosphate component, and the dispersed solid phase comprises the silicate component. The continuous solid phase can further contain therein optional other inorganic material, such as other inorganic oxides and inorganic compounds. A preferred MFDM comprises a continuous solid phase of the condensed phosphate component having dispersed therein the silicate component.

In another preferred embodiment, the MFDM can be described as a mixture of solid particle comprising the condensed phosphate component and the silicate component which are immiscible one with the other. The separate, immiscible components easily separate into distinct particles upon crushing or grinding of the cooled solid components.

The condensed phosphate component can be in an amorphous phase or a crystalline phase, though more commonly and preferably the continuous condensed phosphate component is amorphous. The silicate component can also be in an amorphous phase or a crystalline phase, though more commonly and preferably the dispersed silicate component is crystalline. In general, the dispersed silicate component of the present invention will dissolve more quickly and generate less silicate insoluble material, compared to compositions containing conventional amorphous or crystalline silicate that is processed into the detergent composition by conventional methods.

Additional inorganic oxides can also be optionally included in the MFDM. Preferably, such optional inorganic oxide ingredients are also commonly and preferably used in laundry and cleaning formulations to provide an important function, such as bleaching and stabilizing. Preferred examples of optional inorganic oxides include boron oxide ($B_2O_3$) and sulfur oxide ($SO_3$), commonly in the form of sodium sulfate ($Na_2SO_4$). When included in the MFDM, the level of sodium sulfate (or other salt thereof) can be present at from about 1% to about 50%, by weight, depending upon the need for filler or other functionality in the formulation. Because of the sulfur oxide content in silica, phosphoric rock, trona, and other raw mineral ingredients, the MFDM can contain up to 1% or more of sodium sulfate without having to add sodium sulfate or additional source of sulfur oxide to the raw ingredients charged together to make the MFDM.

Making of MFDM

The MFDM of the present invention is made by the mixing together of two or more natural or partially treated (ground or comminuted) primary raw materials or minerals, in proportions according to the needs of a specific detergent formulation, raising the mixture to a reacting temperature, such as by introducing the mixture into a furnace, reacting the mixture at the reacting temperature, and forming the MFDM. One or more of the materials can be in the molten state upon mixing of the other ingredients. The process system for making the MFDM can be batch or continuous.

The primary raw materials or minerals contains a source of phosphorus oxide, a source of silicon oxide, and a source of disodium oxide. Preferred sources of phosphorus oxide are phosphoric rock and phosphorus acid. Preferred sources of silicon oxide are silica sand, as well as quartzite and cristobalite. The disodium oxide is needed to form the various phosphate and silicate species, and can be obtained from trona, sodium carbonate, and sodium hydroxide.

The raw materials are balanced to provide a MFDM containing a desired or preferred ratio and level of phosphate ($P_2O_5$) to silica ($SiO_2$) for use in laundry and cleaning products. Other inorganic raw materials useful in laundry and cleaning products can, and preferably are, included in the mixture, such as an alkali oxide, preferably $Na_2O$, and carbonate.

In a typical process, the sources of phosphorus oxide, silicon oxide, and disodium oxide are typically mixed together as ground or communited particles. The mixture of phosphorus oxide, silicon oxide, and disodium oxide can be further ground as needed, and then charged into a furnace or equivalent vessel capable of increasing the temperature of the mixture to a reacting temperature. The reacting temperature includes a temperature at which phosphous oxide is dehydrated and "polymerizes" into the ultraphosphates, polyphosphates and metaphosphates. The reacting temperature can also be a fusing temperature at which the silicon dioxide can fuse into silicates. Longer reacting time and higher reacting temperature generally increases the extent of polymerization of the phosphorus oxide into the linear polyphosphates and cyclic metaphosphates toward an equilibrium which is dependent upon the ratio of sodium oxide and $P_2O_5$ in the reaction mixture. Generally the reacting temperature results in a mixture that is molten. Typical temperatures for reacting and/or heat fusing the mixture are from about 600° C. to about 1500° C., more preferably from about 900° C. to about 1300° C., and most preferably from about 1000° C. to about 1200° C. The reacting temperature should be selected to avoid any decomposition of any optional inorganic materials present. For example, sodium sulfate decomposes at temperatures above about 1300° C.

It is economically preferred that the reacting of the mixture is for a time as short as possible. The time should be sufficient to effect fusing of the components, and to ensure a sufficiently uniform molten mixture. Such time generally takes 10 hours or less, and preferably from about 1 hour to about 5 hours.

Prior to forming the final MFDM product, other optional materials, generally in the form of powders or glasses, can be admixed or dissolved with or into the molten, reacted mixture after exiting the furnace.

The resulting MFDM can then be formed into a powder, a glass, or a liquid. The powder can be prepared by cooling the fused, molten mixture into a cullet by any means, such as by air cooling, cooling within the furnace, or by water cooling. The solidified cullet can then be ground into a powder of the appropriate particle size and distribution by known means. Alternatively, a powdered MFDM can be formed by atomizing the molten mixture into droplets and cooling the droplet below its glass temperature. The powder is generally hydratable and hygroscopic. Preferably the powder particles range in size from about 5 microns to about 1500 microns, and more preferably about 50 microns to about 1000 microns. A preferred powder has particles substantially having a mean particle size from about 200 microns to about 1000 microns.

The resulting MFDM can be formed into a glass or a liquid by dissolving the molten mixture to an extend with water or other suitable solvent, whereby the glass or liquid solution of the MFDM can be obtained at ambient or storage temperatures.

The process can optionally, though preferably, comprise the further step of removing impurities and inert materials from the reacted mixture, prior to or subsequent to forming the powder or glass MFDM. The inorganic raw materials can also consist of fully treated inorganic materials which have been processed to remove impurities and processed into a solid or liquid form suited for addition to detergent products. However, the treatment to remove impurities of the several fully treated raw materials is unnecessary when practicing the present invention, since a single process step of removing impurities can be used after the raw material mixture has been reacted. Partial treatment, such as an acid or alkaline attack on the natural raw material, or as by grinding, sieving and screening, can be used. In general, it is unnecessary to treat the raw materials of the MFDM to eliminate a compound or element that can be used in the laundry or cleaning product. In the production of carbonate from the natural raw material trona, silica is usually removed as an impurity. In the present invention, however, when carbonate is included as a raw material to make the MFDM, the silica present is used to form a part of the silicate ($SiO_2$) of the MFDM. Not only is it unnecessary to remove the silica from the trona as an impurity, but that in fact it is preferred to use the raw trona since it provides an additional source of silica for the MFDM.

Furthermore, if a specific structure for the product is needed for specific purposes of the detergent producer, the process can further comprise the step of annealing the MFDM.

The obtained multifunctional detergent material is soluble and/or dispersible in water, allowing the material to perform the functions of any two or more of a builder, a conditioner, a filler, an alkaline agent, and carrier, in laundry and cleaning formulations and in a manufacturing process for making such formulations, at less expense in material cost than the individual raw materials that are normally used and that are replaced by the MFDM.

The MFDM allows the detergent producer to avoid paying for the charge of handling and transporting multiple raw materials, and for transporting some unneeded volatile or gaseous components that are present in the raw materials, such as the $CO_2$ that is chemically present in sodium carbonate.

Use of MFDM in Laundry and Cleaning Products

The MFDM of the present invention is particularly useful as an ingredient in laundry and cleaning products, and can provide multiple functions for laundry and cleaning products in a single ingredient, including the functions of a builder, a conditioner, an alkaline agent, a filler, a carrier, and a neutralizing agent. The MFDM is particularly effective in granular and liquid detergent products in view of its unique and surprising properties.

When formulated into laundry and cleaning products, the MFDM provides substantially equivalent cleaning, in terms of stain removal and whiteness maintenance, compared to detergent formulations prepared from conventional raw materials which deliver equivalent levels of silicate ($SiO_2$), phosphate ($P_2O_5$) and alkalinity ($Na_2O$). It has also been found that the MFDM of the present invention is capable of controlling Ca++ in the wash solution, to the same extent as STPP on an equal $P_2O_5$ basis, thereby inhibiting the precipitation of anionic surfactants by the Ca++, to about the same extent as STPP.

Surprisingly, laundry and cleaning product formulations containing a MFDM that comprises a dispersed silicate component yield less insoluble and precipitated silicate material into the wash solution as compared to conventional formulations containing equivalent levels of the conventional silicate material (water glass) and processed by conventional methods. Without being bound by any theory, it is believed that the silicate component dissolves more rapidly and is dispersed within the wash solution, compared to amorphous or crystalline silicate contained in products made by conventional methods.

The laundry and cleaning formulation containing the MFDM also provides a substantially equivalent level of hardness sequestration compared to a formulation built with either pyrophosphate or tripolyphosphate, or both, on an equal $P_2O_5$ basis. It is also well known that conventional formulations built with pyrophosphate experience a reduction in builder effectiveness as the level of water hardness in the wash water increases and the product is used at close to the underbuilt conditions. This reduction in builder effectiveness is called the "pyro dip". The pyro dip represents those molar ratios of builder capacity to hardness approaching and below 1:1 (compared to an overbuilt condition where the molar ratio of builder to hardness is greater than 1:1) where the pyrophosphate complex is insoluble and precipitates. The effect of the pyro dip in the washing process is an increase in soil redeposition on the clothes. It has been found that the present MFDM is a more effective builder than pyrophosphate at such near-underbuilt and underbuilt conditions, and there is not seen an increase in soil redeposition at equivalent levels of MFDM on an equal $P_2O_5$ basis. It is believed that the presence of the polyphosphates metaphosphates in the MFDM provides this benefit. It has been known to add low levels of polyphosphate (commercially available from FMC Corporation as "Glass H") to pyrophosphate and orthophosphate-built detergents to improve anti-redeposition due to the pyro dip. The present invention provides a single multifunctional detergent material with a builder capacity equivalent to pyrophosphate and the anti-redeposition (pyro dip) protection of a conventional polyphosphate.

Laundry and Cleaning Products Containing MFDM

The present invention also includes laundry and cleaning products containing the MFDM. These products can be in a variety of forms, including granules, fine powders, liquids, gels, pastes, bars, solid abrasives, etc.

The present invention provides laundry or cleaning detergent compositions, including granular, powdered, paste, and bar compositions, and components thereof, comprising, by weight, from 1–45% a detergent surfactant, and from 3–95% the multifunctional detergent material.

A preferred laundry detergent composition of the present invention comprises by weight from 1–45% detergent surfactant and from 3%–50% of a condensed phosphate component selected from the group consisting of the linear polyphosphates of the formula I, the cyclic metaphosphates of the formula II, and mixtures thereof.

Detergent surfactants can include anionic surfactants, cationic surfactants, nonionic surfactants, amphoteric surfactants, and mixtures thereof.

The anionic surfactant can be selected from alkylbenzene sulfonate, alkyl sulfate, alkyl ethoxy ether sulfate, and mixtures thereof. Preferred are alkylbenzene sulfonate and alkyl sulfate.

Alkylbenzene sulfonates are salts of alkylbenzene sulfonic acid with an alkyl portion which is linear or branched, preferably having from about 8 to about 18 carbon atoms, more preferably from about 9 to about 16 carbon atoms. The alkyl of the alkylbenzene sulfonic acid preferably have an average chain length of from about 10 to about 14 carbon atoms, more preferably from about 11 to about 13 carbon atoms. The alkyl are preferably saturated. Branched or mixed branched alkylbenzene sulfonates are known as ABS. Linear alkylbenzene sulfonates, known as LAS, are more biodegradable than ABS, and are preferred for the subject invention compositions. The salt can be sodium, potassium, and ammonium, preferably sodium. Alkylbenzene sulfonates and processes for making them are disclosed in U.S. Pat. Nos. 2,220,099 and 2,477,383, incorporated herein by reference.

Alkyl sulfates (AS) are the alkali salts of alkyl sulfuric acids, preferably having carbon chain lengths in the range of from about $C_{10}$ to about $C_{20}$. Alkyl sulfates having chain lengths from about 12 to about 18 carbon atoms are preferred. AS surfactants preferably have average chain lengths from about 12 to about 14 carbon atoms. Especially preferred are the alkyl sulfates made by sulfating primary alcohol derived from coconut or tallow and mixtures thereof. Salts can be sodium, potassium, lithium, ammonium, and alkylammonium salts. Preferred salts of alkyl sulfates are sodium and potassium salts, especially sodium salts.

Alkylethoxy ether sulfate (AES) surfactants useful in the subject invention compositions have the following structure: $R'''O(C_2H_4O)_xSO_3M$, where R''' is alkyl, preferably saturated linear alkyl, of from about 10 to about 20 carbon atoms, x is on average from about 1 to about 9, preferably from about 1 to about 7, more preferably from about 2 to about 5, especially about 3, and M is a water-soluble cation, preferably sodium or potassium. The AES surfactants are typically obtained by sulfating alkyl ethoxy alcohol with gaseous $SO_3$ in a falling film reactor, followed by neutralization with NaOH, as is well known in the art.

In addition to the MFDM, optional supplemental builders can be added to the composition. The optional builders can be contained at levels of from about 1% to about 35% by weight in the composition. Such optional builders can include:

1. Phosphate-containing detergent builders, including tripolyphosphates, pyrophosphates, glassy polymeric metaphosphates, and alkyl phosphonates. When other phosphate-containing detergent builders, the detergent composition can comprise from 1–50% total phosphate-containing builder, wherein at least 2% by weight of the total phosphate-containing builder comprises the condensed phosphates of the multifunctional detergent material.

2. Inorganic non-phosphate builders, including alkali metal silicates, carbonates (including bicarbonates and sesquicarbonates), citrates, and aluminosilicates. Aluminosilicate builders include those having the empirical formula: $M_z(zAlO_2)_y.vH_2O$ wherein z and y are integers of at least 6, the molar ratio of z to y is in the range from 1.0 to about 0.5, and v is an integer from about 15 to about 264. The aluminosilicates can be crystalline or amorphous in structure and can be naturally-occurring aluminosilicates or synthetically derived, and preferred synthetic crystalline aluminosilicate ion exchange materials include Zeolite A, Zeolite P (B), Zeolite MAP and Zeolite X. An especially preferred embodiment is the crystalline aluminosilicate ion exchange material known as Zeolite A, having the formula $Na_{12}((AlO_2)_{12}(SiO_2)_{12}).vH_2O$ wherein v is from about 20 to about 30, especially about 27.

3. Organic detergent builders, including polycarboxylate builder compounds having a plurality of carboxylate groups, preferably at least 3 carboxylates. Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Other optional ingredients that can be included in the compositions can include:

1. Chelating agents, selected from the group consisting of amino carboxylates, amino phosphonates, polyfunctionally-substituted aromatic chelating agents and mixtures thereof, and preferably selected from ethylenediamine tetracetates, N-hydroxyethylethylenediaminetriacetates, nitrilotriacetates, ethylenediamin e tetraproprionates, triethylenetetraamine hexacetates, diethylenetriamine pentaacetates, diethylenetriamine penta(methylene phosphonic acid), ethylenediamine tetra(methylene phosphonic acid), and mixtures and salts and complexes thereof. Such chelants can be included in the subject compositions at a level up to about 5%, preferably from about 0.1% to about 2%, more preferably from about 0.2% to about 1.5%, more preferably still from about 0.5% to about 1%.

2. Polymeric dispersing agents, including polymeric polycarboxylates, substituted (including quarternized and oxidized) polyamine polymers, and polyethylene glycols, such as: acrylic acid-based polymers having an average molecular of about 2,000 to about 10,000; acrylic/maleic-based copolymers having an average molecular weight of about 2,000 to about 100,000 and a ratio of acrylate to maleate segments of from about 30:1 to about 1:1; maleic/acrylic/vinyl alcohol terpolymers; polyethylene glycol (PEG) having a molecular weight of about 500 to about 100,000, preferably from about 1,000 to about 50,000, more preferably from about 1,500 to about 10,000; polyaspartate and polyglutamate; carboxymethylcellulose (CMC) materials; and water soluble or dispersible alkoxylated polyalkyleneamine materials. These polymeric dispersing agents, if included, are typically at levels up to about 5%, preferably from about 0.2% to about 2.5%, more preferably from about 0.5% to about 1.5%. The substituted polyamine polymers are disclosed in WO 98/08928, published Mar. 5, 1998, incorporated herein by reference.

3. Polymeric soil release agent, or "SRA", having hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters; sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, issued Nov. 6, 1990 to Scheibel et al.; nonionic end-capped 1,2-propylene/polyoxyethylene terephthalate polyesters of U.S. Pat. No. 4,711,730, issued Dec. 8, 1987 to Gosselink et al.; an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two-end-cap units derived from sodium 2-(2-hydroxyethoxy)-ethanesulfonate; oligomeric esters comprising: (1) a backbone comprising (a) at least one unit selected from the group consisting of dihydroxy sulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$((CAP)_a(EG/PG)_b(DEG)_cPEG)_d(T)_e(SIP)_f(SEG)_g(B)_h)$$

wherein CAP, EG/PG, PEG, T and SIP are as defined hereinabove, DEG represents di(oxyethylene)oxy units, SEG represents units derived from the sulfoethyl ether of glycerin and related moiety units, B represents branching units which are at least trifunctional whereby ester linkages are formed resulting in a branched oligomer backbone, a is from about 1 to about 12, b is from about 0.5 to about 25, c is from 0 to about 12, d is from 0 to about 10, b+c+d totals from about 0.5 to about 25, e is from about 1.5 to about 25, f is from 0 to about 12; e +f totals from about 1.5 to about 25, g is from about 0.05 to about 12; h is from about 0.01 to about 10, and a, b, c, d, e, f, g, and h represent the average number of moles of the corresponding units per mole of the ester; and the ester has a molecular weight ranging from about 500 to about 5,000.; and; cellulosic derivatives such as the hydroxyether cellulosic polymers available as METHOCEL® from Dow; the $C_1$–$C_4$ alkyl celluloses and $C_4$ hydroxyalkyl celluloses, see U.S. Pat. No. 4,000,093, issued Dec. 28, 1976 to Nicol et al., and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100® and METOLOSE SM200®, which are the trade names of methyl cellulose ethers manufactured by Shinetsu Kagaku Kogyo KK 4. Enzymes, including proteases, amylases, lipases, cellulases, and peroxidases, as well as mixtures of two or more thereof. Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130 756, published Jan. 9, 1985) and Protease B (see European Patent Application 251 446, published Jan. 7, 1988). Amylases include, for example, α-amylases described in British Patent Specification No. 1,296,839 (Novo), RAPIDASE®, International Bio-Synthetics, Inc. and TERMAMYL®, Novo Industries. Amylase is preferably included in the subject compositions such that the activity of the amylase is from about 0.02 KNU to about 5 KNU per gram of the composition, more preferably from about 0.1 KNU to about 2 KNU, more preferably still from about 0.3 KNU to about 1 KNU. (KNU is a unit of activity used commercially by Novo Ind.) The cellulases usable in the subject compositions include both bacterial and fungal cellulase. Preferably, they will have a pH optimum of between 5 and 9.5. Suitable cellulases are disclosed in U.S. Pat. No. 4,435,307, Barbesgoard et al., issued Mar. 6, 1984, which discloses fungal cellulase produced from Humicola insolens and Humicola strain DSM1800, a cellulase 212-producing fungus belonging to the genus Aeromonas, and cellulase extracted from the hepatopancreas of a marine mollusk (*Dolabella Auricula Solander*). Suitable cellulases are also disclosed in British Patent Spec. Nos. 2,075,028 and 2,095,275 and German Patent Spec. No. 2,247,832. Cellulases disclosed in PCT Patent Application No. WO 91/17243, such as CAREZYME® (Novo), are especially useful cellulases. Cellulase is preferably included in the subject compositions such that the activity of the cellulase is from about 0.1 CEVU to about 20 CEVU per gram of the composition, more preferably from about 1 CEVU to about 10 CEVU, more preferably still from about 2 CEVU to about 5 CEVU. (The activity of a cellulase material (CEVU) is determined from the viscosity decrease of a standard CMC solution as follows. A substrate solution is prepared which contains 35 g/l CMC (Hercules 7 LFD) in 0.1 M tris buffer at pH 9.0. The cellulase sample to be analyzed is dissolved in the same buffer. 10 ml substrate solution and 0.5 ml enzyme solution are mixed and transferred to a viscosimeter (e.g., Haake VT 181, NV sensor, 181 rpm), thermostated at 40° C. Viscosity readings are taken as soon as possibly after mixing and again 30 minutes later. The activity of a cellulase solution that reduces the viscosity of the substrate solution to one half under these conditions is defined as 1 CEVU/liter.) Suitable lipase enzymes for detergent usage include those produced by microorganisms of the Pseudomonas group, such a *Pseudomonas stutzeri* ATCC 19.154, as disclosed in British Patent 1,372,034. See also lipases in Japanese Patent Application 53/20487, laid open to public inspection on Feb. 24, 1978. This lipase is available from Amano Pharmaceutical Co. Ltd., Nagoya, Japan, under the trade name Lipase P. Other commercial lipases include Amano-CES, lipases ex *Chromobacter viscosum*, e.g., *Chromobacter viscosum* var. lipolyticum NRRLB 3673, commercially available from Toyo Jozo Co., Tagata, Japan; and further Chromobacter viscosumlipases from U.S. Biochemical Corp., U.S.A. and Disoynth Co., The Netherlands, and lipases ex *Pseudomonas gladioli*. The LIPOLASE® enzyme derived from *Humicola lanuginosa* and commercially available from Novo (see also EP 341 947) is a preferred lipase. Lipase is preferably included in the subject compositions such that the activity of the lipase is from about 0.001 KLU to about 1 KLU per gram of the composition, more preferably from about 0.01 KLU to about 0.5 KLU, more preferably still from about 0.02 KLU to about 0.1 KLU. (KLU is a unit of activity used commercially by Novo Ind.) Peroxidase enzymes are used in combination with oxygen sources, e.g., percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by Kirk, assigned to Novo Industries ANS. The subject compositions typically comprise up to about 5%, preferably from about 0.01% to about 2%, more preferably about 0.2% to about 1%, of commercial enzyme preparations.

5. Bleaching compounds, including bleaching agents and bleach, including perborate bleaches, e.g., sodium perborate (e.g., mono- or tetra-hydrate); percarboxylic acid bleaching including magnesium monoperoxyphthalate hexahydrate, the magnesium salt of metachloro perbenzoic acid, 4-nonylamino4-oxoperoxybutyric acid and diperoxydodecanedioic acid; peroxygen bleaching agents including sodium carbonate peroxyhydrate and equivalent "percarbonate" bleaches, sodium pyrophosphate peroxyhydrate, urea peroxyhydrate, and sodium peroxide; persulfate bleach (e.g., OXONE®, manufactured commercially by DuPont); bleach activators, which lead to the in situ production in aqueous solution (i.e., during the washing process) of the peroxy acid corresponding to the bleach activator, such as nonanoyloxybenzene sulfonate (NOBS) and tetraacetyl ethylenediamine (TAED) activators are typical, and mixtures thereof. When present, bleaching agents will typically be at levels up to about 20%, preferably from about 1% to about 5%, of the subject compositions. If present, the amount of bleach activators will typically be up to about 70%, preferably from about 0.5% to about 5% of the subject compositions.

6. Fabric softening clay, such as a smectite-type clay.

7. Dye transfer inhibiting (DTI) ingredients, which prevent diminishing of color fidelity and intensity in fabrics, including hydrogen peroxide or a source of hydrogen peroxide, polyvinyipyrridine N-oxide, polyvinylpyrrolidone (PVP), PVP-polyvinylimidazole copolymer, copolymers of N-vinylpyrrolidone and N-vinylimidazole polymers (referred to as "PVPI"), and mixtures thereof. The amount of DTI included in the subject compositions, if any, is about 0.05%–5%, preferably about 0.2%–2%.

8. Photobleaches, particularly phthalocyanine photobleaches which are described in U.S. Pat. No. 4,033,718 issued Jul. 5, 1977, incorporated herein by reference, and preferably zinc and aluminum phthalocyanine compounds, available under the tradename TINOLUX® and QUANTUM® (Ciba Geigy). The photobleach components, if included, are typically in the subject compositions at levels up to about 0.02%, preferably from about 0.001% to about 0.015%, more preferably from about 0.002% to about 0.01%.

9. Fillers, optionally used in addition to any filter function provided by the MFDM, such as sodium sulfate, calcium carbonate (Calcarb), talc and hydrated magnesium silicate-containing minerals. Optional additional filler material, if included, is typically at levels up to about 60%.

10. Optical brighteners, including derivatives of stilbene, pyrazoline, coumarin, carboxylic acid, methinecyanines, dibenzothiphene-5,5-dioxide, azoles, 5- and 6-membered ring heterocycles, and other miscellaneous agents, and preferably brighteners identified in U.S. Pat. No. 4,790,856, issued to Wixon on Dec. 13, 1988, that included the PHOR-WHITE® series of brighteners from Verona; TINOPAL UNPA®, TINOPAL CBS® and TINOPAL 5BM®, TINOPAL AMS-GX®, available from Ciba-Geigy; ARTIC WHITE CC® and ARTIC WHITE CWD®, available from Hilton-Davis, located in Italy; the 2-(4-styryl-phenyl)-2H-napthol[1,2-d]triazoles; 4,4'-bis-(1,2,3-triazol-2-yl) stilbenes; 4,4'-bis(styryl)bisphenyls; and the aminocoumarins. Specific examples of these brighteners include 4-methyl-7-diethylamino coumarin; 1,2-bis(-benzimidazol-2-yl)ethylene; 1,3-diphenyl-phrazolines; 2,5-bis (benzoxazol-2-yl)thiophene; 2-styryl-napth-[1,2d]oxazole; 2-(stilbene-4-yl)-2H-naphtho-[1,2-d]triazole; and most preferably 4,4'-bis((4-anilino-6-bis(2-hydoxyethyl)-amino-1,3,5-trizin-2-yl)amino)stilbene-2,2'-disulfonic acid disodium salt, 4-4'-bis(2-sulfostyryl)biphenyl (Br2) and 4,4'-bis((4-anilino-6-morpholino-1,3,5-triazin-2-yl)-amino)stilbene-2,2'-disulfonic acid disodium salt. Such optical brighteners, or mixtures thereof, if included, are typically at levels in the compositions up to about 1%, preferably about 0.01%–0.3%.

11. Water and solvents: The granular laundry and cleaning compositions of the subject invention, including laundry bars, typically comprise from about 1% to about 25% water total moisture (free moisture and hydrate moisture), preferably from about 4% to about 15% water, more preferably from about 5% to about 9% water. The amount of moisture will depend upon the level of hydration of the inorganic salts in the composition. Aqueous liquid laundry and cleaning compositions typically will contain from about 5% to about 95% water, depending upon the concentration of actives and other solvents. Other solvents can include the aforementioned detergent surfactants, as well as monohydric and polyhydric alcohols, and polymers.

12. Miscellaneous ingredients can include dyes, pigments, germicides, perfumes, polyethylene glycol, glycerine, sodium hydroxide, alkylbenzene, fatty alcohol, and other minors, some of which are impurities carried in from surfactant-making processes, can also be incorporated in the subject compositions. If included, they are typically at levels up to about 3%.

Processing of Laundry and Cleaning Products Containing MFDM

The MFDM of the present invention can be processed into laundry and cleaning products in manners very similar to conventional functional materials.

In a first method of making a laundry or cleaning product containing a MFDM, the MFDM in a powdered or particulate form can be dry mixed with other powdered ingredients and then further mixed with liquid components including anionic surfactant pastes, water, and liquid polymers, into a homogenous viscous detergent slurry. The viscous slurry can then be spray dried in a conventional spray tower by spraying the slurry as slurry droplets into a drying tower along with counter- or co-current hot air, to remove moisture from the sprayed slurry droplet, thereby forming substantially dry porous detergent granules (also known as base granules) having a bulk density of about 450 g/liter or less. Such spray-drying systems and methods of preparing detergent slurries and spray-drying the detergent slurries to make base granules are well known, and are disclosed in U.S. Pat. Nos. 3,629,951 and 3,629,955 (Davis et al.), U.S. Pat. No. 4,083,813 (Wise et al.), U.S. Pat. No. 4,006,110 (Kenney et al.), and U.S. Pat. No. 4,129,511 (Ogoshi et al.), all such references herein incorporated by reference. The base granules containing or made using the MFDM can then be dry mixed with other particulate and powdered detergent components, such as enzymes and bleaches, or contacted with minor levels of spray-added ingredients such as perfumes and functional polymers to form a detergent product, or can be further processed, such as by compaction, grinding, agglomeration, or compression, to form detergent particles of a different size, shape, porosity, and/or structure.

The mixing of MFDM into the slurry and then spray drying of the slurry into a base granule can expose the MFDM to both moisture and high temperature. Depending on the amount of time the MFDM remains in the slurry state, and on the temperatures of the slurry and the resulting base granules produced by spray drying, a significant amount of the linear polyphosphates and cyclic metaphosphates can be hydrolyzed to lower molecular weight condensed phosphate species, including tripolyphosphate and pyrophosphate. Under ordinary slurrying and spray-drying conditions, much of, though not necessarily all, of the linear polyphosphates and cyclic metaphosphates can be hydrolyzed to the lower molecular weight condensed phosphate species. Since the MFDM can be used in large amounts in a detergent composition, even if the polyphosphate material hydrolyses to an significant extent to, for example, pyrophosphate and orthophosphate, there still remains a sufficient amount of the polyphosphate material to prevent a loss in builder performance due to the "pyro dip".

In a second method of making a laundry or cleaning product containing a MFDM, the MFDM in a powdered or particulate form can be optionally mixed with other powdered ingredients, and mixing with a binder liquid in an energy-intensive mixer to form agglomerates. The binder liquid can include an anionic, nonionic, or other detergent surfactant paste, water glass (silicate), water, and liquid polymers. Optional other powdered ingredients can include, but are not limited to, aluminosilicates, layered silicates, carbonate, bicarbonate, and softening clays, as well as spray-dried detergent powders. The agglomeration can be conducted in the following preferred mixers, alone or in combination with other mixers, and either in a batch or continuous process: an Elrich Type R Intensive Mixer, a Littleford mixer, a Lodige type CB Mixer, and a Lodige type KM Mixer. Other equipment that can also be used to agglomerate the dry mixture with a liquid binder includes a schugi mixer and an O'Brien mixer, as well as any of the known fluid bed agglomerating systems. Such processes are described in the following U.S. Patents, and are incorporated herein by reference: U.S. Pat. No. 5,009,804 (Clayton et al.); U.S. Pat. No. 5,108,646 (Beerse et al.); U.S. Pat. No. 5,489,392 (Capeci et al.); U.S. Pat. No. 5,496,487 (Capeci et al.); U.S. Pat. No. 5,494,599 (Goovaerts et al.); and U.S. Pat. No. 5,616,550 (Kruse et al.).

In another method of making a laundry or cleaning product containing a MFDM, the MFDM in a powdered or particulate form can serve an alkaline agent in a dry neutralization process, whereby the MFDM is mixed with a liquid anionic detergent acid in an energy-intensive mixer, thereby neutralizing the detergent acid and forming an agglomerate containing the corresponding anionic detergent surfactant. In such a process, the MFDM is either the principle or a co-alkaline agent, replacing or supplementing more conventional alkaline agents such as sodium carbonate, sodium bicarbonate, and sodium metasilicate. Depending on the reserve alkalinity in the MFDM, and on the proportion of anionic detergent acid to be neutralized, an amount of aqueous sodium hydroxide or sodium carbonate, or other alkaline source, can be added with the MFDM to ensure complete and rapid neutralization of the detergent acid to the anionic detergent surfactant. The neutralization and agglomeration can be conducted in the following preferred mixers, alone or in combination with other mixers, and either in a batch or continuous process: an Elrich Type R Intensive Mixer, a Littleford mixer, a Lodige type CB Mixer, and a Lodige type KM Mixer. Such processes are described in the following U.S. Patents, and are incorporated herein by reference: U.S. Pat. No. 2,688,035 (Jacob et al.); GB Patent 1,369,269 (Colgate-Palmolive); U.S. Pat. No. 4,587,029 (Brooks); U.S. Pat. No. 4,919,847 (Barletta et al.); U.S. Pat. No. 5,164,108 (Appel et al.); European Patent 352,135 (Unilever); U.S. Pat. No. 5,527,489 (Tadsen et al.); and U.S. Pat. No. 5,573,697 (Riddick et al.).

ANALYTICAL METHODS a) Ion Chromatography of Polyphosphates

Principles and Scope

The characterization of the distribution of polyphosphates and metaphosphates (referred to collectively within this method as polyphosphates) in a MFDM was carried out by ion chromatography (IC) with suppressed conductivity detection. In IC, the separation of the polyphosphate components is achieved when an aqueous solution of the sample carried by the alkaline mobile phase (or eluant) is passed through an anion exchange packing (stationary phase composed of a polymeric resin bed that contains functionalized active sites) contained in the chromatographic column. In the column the sample components migrate and interact with the stationary phase. The migration of a given anion is a function of the equilibrium distribution of the sample between the mobile and the stationary phase. Components having distributions favoring the stationary phase migrate more slowly than those having distributions favoring the mobile phase. Separation therefore results from different migration rates as a consequence of the equilibrium distribution or components affinity for either of the two phases. Usually, the chemistry between the stationary and the mobile phases is different enough that the analyte will interact with one phase more than the other. It is this discrepancy which enables the separation to take place. For the case of polyphosphates the molecular size of the polyphosphates favor their retention in the stationary phase so the order of elution is proportional to the phosphate chain size.

The detection of the condensed phosphate peaks is achieved in a conductivity detector where the present of more ions in the solution passing through detector cell, will allow more electrical current to flow between the charged electrodes, resulting in current peaks proportional to the concentration of conductive species in the solution. The sensitivity of the detector is significantly improved by suppressing the background conductivity of the mobile phase just before passing through the detector. This is achieved using an anion self-regenerating suppression system.

Instrument Operation

Flow rate: 2.0 ml/min.

Pre-run Column Equilibration

| | |
|---|---|
| Eluant stand by | 35% 200 mM NaOH, 65% $H_2O$ |
| 0.1 min | 8% 200 mM NaOH, 92% $H_2O$ |
| 5 min | 8% 200 mM NaOH, 92% $H_2O$ |

Chromatographic Run

| | |
|---|---|
| Eluant Initial (inject sample) | 8% 200 mM NaOH, 92% $H_2O$ |
| 2 min | 8% 200 mM NaOH, 92% $H_2O$ |
| 90 min | 50% 200 mM NaOH, 50% $H_2O$ |
| 100 min | 35% 200 mM NaOH, 65% $H_2O$ |
| Detector | Background conductivity, 3 uS (approx.) |
| Range | 30 uS |
| Suppressor Flow | 3–4 mL/min |
| Suppressor | 500 mA |
| Temperature Compensation | 1.7° C. |
| Analysis run time | 100.0 minutes |

Quantitation of % Polyphosphates from the IC Chromatograms

The composition in weight percentages of the different polyphosphates is calculated using Peak Area/weight of $P_2O_5$ response factors obtained using sodium pyrophosphate, metaphosphate and tripolyphosphate analytical standards adjusted for the total $P_2O_5$ level present in the material.

b) X-Ray Diffraction

Principles and Scope

The identification of a crystalline component of MFDM is carried out by X-Ray Diffraction (XRD). It is well known that when crystalline materials are bombarded with x-rays, scattering patterns are produced. If a monochromatic x-ray beam falls on a powder crystalline sample, the beam is reflected by each of the crystal planes. Each separate reflected beam interacts with the other reflected beams. If the beams are not in phase, they destroy each other, hence no x-ray emerges. If the beams are in phase (coherent), the net result is a diffraction pattern. Coherence occurs, as described by the Bragg equation, when $n\lambda=2d\sin\theta$, where $n\lambda$ =whole number of x-ray wavelength, d=spacing between the crystal plane, and $\theta$=angle of incidence.

For a given powder XRD experiment conducted on a Bragg-Brentano diffractometer, one varies the angle between the X-ray tube and a monochromator, which serves as the detector. The resultant pattern is a plot of the diffraction intensities (in counts per second) as a function of the angle ($2\theta$). Qualitative identification of the crystalline components are then obtained by matching the resultant pattern to previously identified standard patterns. If the sample is multiphase, the pattern is just a superimposed pattern of the individual components. It is also possible to estimate the amount of amorphous content of a sample, since this type of scattering gives rise to an increased baseline.

Qualitative Identification

A Bragg-Brentano style diffractometer is used to identify the crystalline component. The sample is top packed into an Anton Parr TTK sample holder. The program used to analyze the sample is a normal, coupled, continuous scan from 1 to 40° $2\theta$, 2.0 second count time, 0.02° step size at room temperature. The pattern is generated and the identified of the crystalline components matched against standards in the JCPDS database.

c) $P_2O_5$ and $SiO_2$

The level of total P205 in a MFDM and in base granules can be determined by converting all available phosphate species to ortho-phosphate form by acid hydrolysis. This ortho-phosphate is reacted with molybdate in the acid solution and then quantified colorimetrically measuring the blue complex formed by reduction of phosphomolybdate with hydrazine sulfate. The level of $SiO_2$ in both MFDM and base granules can be determined by atomic absorption spectrophotometry directly in a alkaline dissolution of the sample.

To enable the persons having ordinary skill in the art to carry out the process of the above described invention, the following examples, taken in relation with the description herein, are provided only by way of information about the viability of this invention, but without considering that the final product could be used for a specific detergent formulation.

EXAMPLE 1

Ground trona ore, silica sand, and treated (acid attacked) phosphoric rock of known active levels of $Na_2O$, $SiO_2$, and $P_2O_5$, are mixed and homogenized in a mixer to produce a particulate batch having the following weight ratio of the inorganic oxides: 2 $P_2O_5$:2 $Na_2O$:1 $SO_2$.

This batch is fed to a rotary kiln and is reacted at a temperature of about 800° C. for about 1 hour, and is then fed to a furnace to melt the reacted batch at a temperature of about 1200° C. for about 3 hour, to produce one ton of a molten glass product. The molten glass product is cooled with water to form cullet, which is then ground into detergent-size particles of the resulting multifunctional detergent material powder.

EXAMPLE 2

The detergent-size particles of the MFDM of Example 1 are used to prepare a detergent product using a standard spray-drying process for making detergent base granules. A crutcher mix slurry is prepared by mixing together the following liquid and solid ingredients in the following order, to form a slurry at 60 degrees C.: 45 parts $C_{18}$ linear alkylbenzene sulfonate (LAS) paste (40% active), 0.5 parts linear $C_{12}$–$C_{14}$ dimethyl hydroxyethyl quaternary ammonium chloride, 1.5 parts alkyl ethoxy (E3) sulfate paste (30% active), 21.5 parts of the MFDM of Example 1, and 47.5 parts sodium sulfate. The slurry mixture is discharged through a series of atomizing nozzles into a spray-drying tower and contacted with a counter-current stream of hot drying air (240 degrees C.), to provide spray-dried granular detergent base granules having a moisture content (loss at 135 degrees C. in 1 hour) of about 8%. The base granules are admixed with minor amounts of perfume and enzyme, and 4 parts carbonate, to form a detergent product.

EXAMPLE 3

Figure 2:
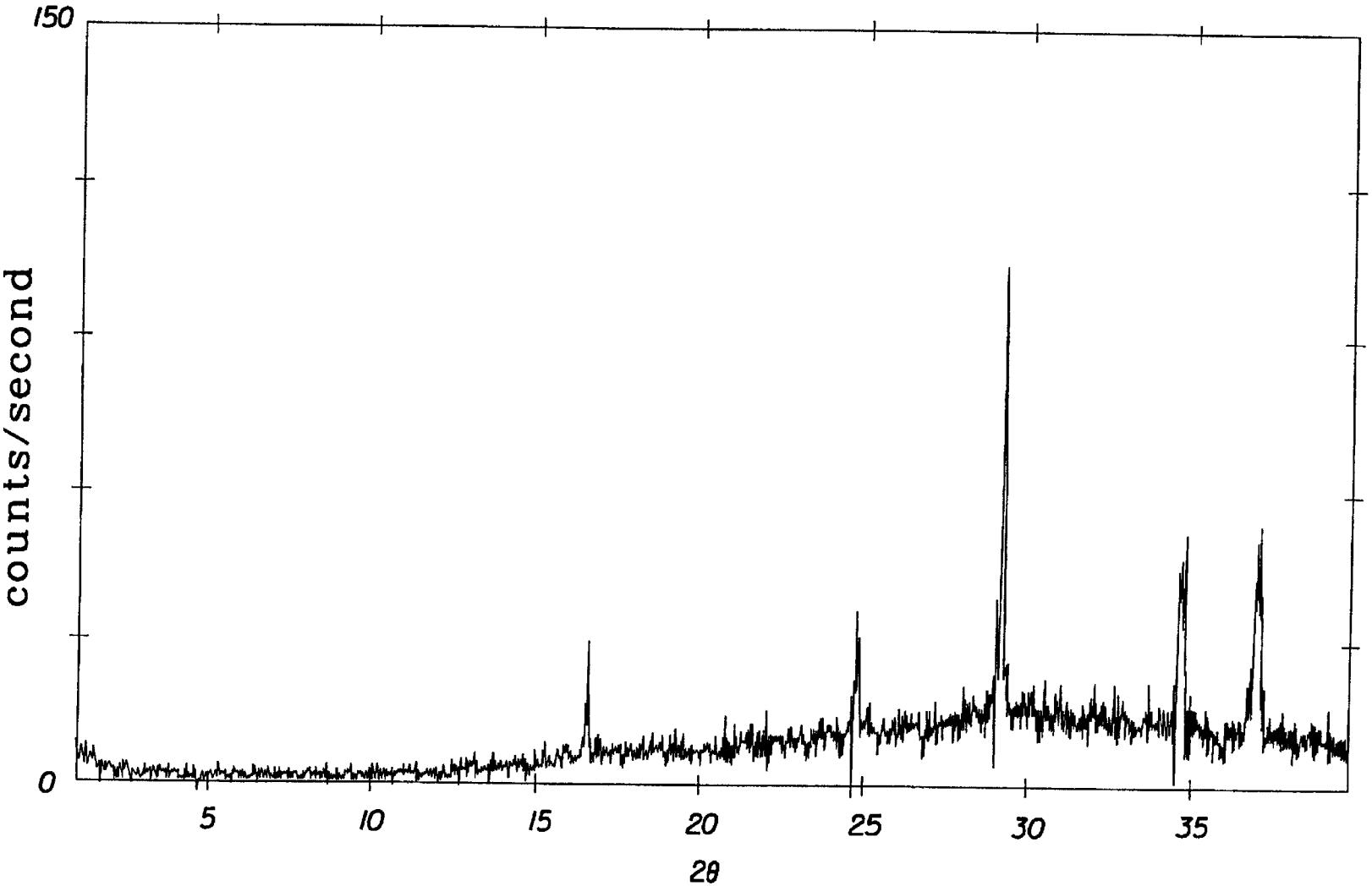
FIG. 2 shows an X-ray Diffraction pattern of a multifunctional detergent material of the present invention, according to Example 3, showing the amorphous polyphosphate and crystalline silicate species contained in the material.

A MFDM of the present invention was made according to the process of the present invention, having an approximate weight ratio of the inorganic oxides of about 9 $P_2O_5$:8 $Na_2O$:3 $SiO_2$. The MFDM was analyzed using Ion Chromatography according to the method herein described. FIG. 1 shows an Ion Chromatogram of the MFDM. The material had a total of 45.1% $P_2O_5$, and 68.9% by weight condensed phosphate species. The condensed phosphate species were comprised, by weight, of about 90.9% higher polyphosphates (n>3), 1.8% STPP, 4.0% TSPP, 2.8% trimetaphosphate (cyclic, n=3), and 0.5% orthophosphate. FIG. 2 shows the X-Ray Diffraction pattern for the MFDM, which has been identified as crystalline sodium silicate (Card No. 16-0818). The ratio of linear polyphosphate to cyclic metaphosphates was about 8.6:1. The material also had a reserve alkalinity of about 35.9 gm NaOHI100 cc material, and 15.24% $SiO_2$.

EXAMPLE 4

Figure 3:
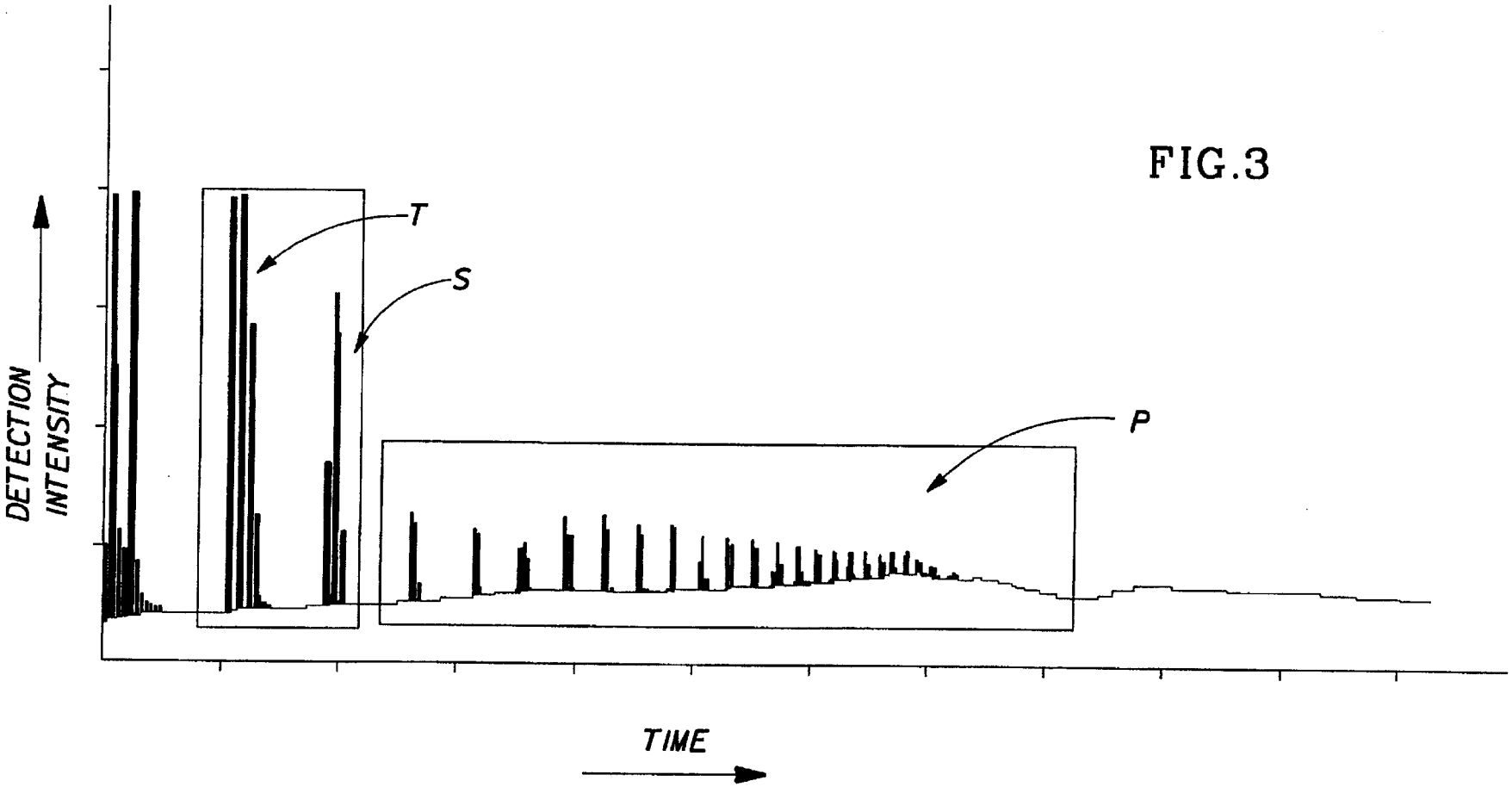
FIG. 3 shows an Ion Chromatogram of a base granule made using a multifunctional detergent material of the present invention, according to Example 4, showing the polyphosphate and other phosphate species contained in the base granule.

The MFDM of Example 3 was processed into a base granule composition generally in accordance with the method described in Example 2. The base granules with the MFDM processed thereinto were analyzed using Ion Chromatography according to the method herein described. FIG. 3 shows an Ion Chromatogram of the base granule containing the MFDM. The material had a total of 17.3% $P_2O_5$, and 32.2% by weight condensed phosphate species. The condensed phosphate species in the base granule were comprised, by weight, of about 9.9% higher polyphosphates (n>3), 6.5% STPP, 61.3% TSPP, 0.0% trimetaphosphate (cyclic, n=3), and 22.3% orthophosphate.

The processing of the MFDM by slurrying and spray-drying to form base granules, results in the hydrolysis of a portion of the polyphosphate material contained in the MFDM to lower polyphosphates, primarily TSPP. The chromatogram of FIG. 3 shows a remaining portion of the polyphosphate in the base granules. The base granule containing the MFDM processed therein provides effective sequestration of hardness in wash solutions.

It is to be understood that the above products and processes are provided only as specific embodiments of the invention and that the persons having ordinary skill in the art will be able. with the teachings of herein disclosed, to carry out different performing examples with different ratios and steps, which will be within the true scope of the invention as defined in the following claims.

What is claimed is:

1. A multifunctional detergent material comprising a condensed phosphate component selected from the group consisting of:

(i) linear polyphosphates of the formula I

I

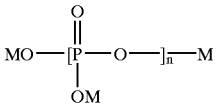

where n is from 3–100, and where M is selected from Na, K, Li, and H, and mixtures thereof;

(ii) cyclic metaphosphates of the formula II

II

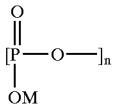

where n is from 3–20, and where M is selected from Na, K, Li, and H, and mixtures thereof; and mixtures thereof; and a silicate component comprising silicon oxide ($SiO_2$) and sodium oxide and wherein the condensed phosphate component and the silicate component are miscible and form a solid solution.

2. The multifunctional detergent material according to claim 1 wherein the condensed phosphate component is the solid continuous phase and the silicate component is the solid phase dispersed within the continuous phosphate component.

3. The multifunctional detergent material according to claim 1 wherein the condensed phosphate component is amorphous.

4. The multifunctional detergent material according to claim 3 wherein the silicate component is crystalline.

5. The multifunctional detergent material according to claim 1 wherein the weight ratio of $P_2O_5$ to $SiO_2$ is from about 1:20 to about 12:1.

6. A laundry detergent composition comprising, by weight:

a) from 1–45% a detergent surfactant, and b) from 3–95% a multifunctional detergent material comprising a condensed phosphate component selected from the group consisting of (i) linear polyphosphates of the formula I

I

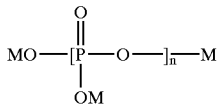

where n is from 3–100, and where M is selected from Na, K, Li, and H, and mixtures thereof;

(ii) cyclic metaphosphates of the formula II

II

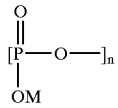

where n is from 3–20, and where M is selected from Na, K, Li, and H, and mixtures thereof; and mixtures thereof; and a silicate component comprising silicon oxide ($SiO_2$) and sodium oxide, and wherein the condensed phosphate component and the silicate component are miscible and form a solid solution.

7. The laundry detergent composition of claim 5 wherein the condensed phosphate component is amorphous phosphate and the silicate component is crystalline silicate.

8. A laundry detergent composition comprising, by weight:

a) from 1–45% detergent surfactant, and b) from 1%–50% of phosphate-containing builder, wherein at least 2% by weight of the phosphate-containing builder comprises a multifunctional detergent material comprising a condensed phosphate component selected from the group consisting of (i) linear polyphosphates of the formula I

I

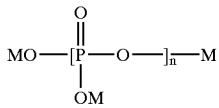

where n is from 3–100, and where M is selected from Na, K, Li, and H, and mixtures thereof;

(ii) cyclic metaphosphates of the formula II

II

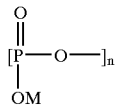

where n is from 3–20, and where M is selected from Na, K, Li, and H, and mixtures thereof; and mixtures thereof; and a silicate component comprising silicon oxide ($SiO_2$) and sodium oxide, and wherein the condensed phosphate component and the silicate component are miscible and form a solid solution.

9. A laundry detergent composition comprising, by weight:

a) from 1–45% detergent surfactant, and b) from 3%–50% of a condensed phosphate component selected from the group consisting of (i) linear polyphosphates of the formula I:

I

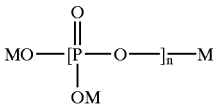

where n is from 4–100, and where M is selected from Na, K, Li, and H, and mixtures thereof;

(ii) cyclic metaphosphates of the formula II:

II

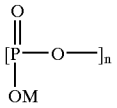

where n from 3–20, and where M is selected from Na, K, Li, and H, and mixtures thereof; and mixtures thereof and wherein the condensed phosphate component and the silicate component are miscible and form a solid solution.

* * * * *